US006929560B1

(12) United States Patent
Roshala et al.

(10) Patent No.: US 6,929,560 B1
(45) Date of Patent: Aug. 16, 2005

(54) GOLF SWING TRAINING DEVICE

(76) Inventors: David Z. Roshala, 227 Spencer Ave., Sharon, PA (US) 16146; J. David Wible, 319 Buhl Blvd., Sharon, PA (US) 16146

( * ) Notice: Subject to any disclaimer, the term of this patent is extended or adjusted under 35 U.S.C. 154(b) by 118 days.

(21) Appl. No.: 10/354,390

(22) Filed: Jan. 31, 2003

(51) Int. Cl.[7] ..... A63B 69/36; A63B 53/16; A63B 53/04

(52) U.S. Cl. ..... 473/256; 473/324

(58) Field of Search ..... 473/256, 334, 473/341, 335, 336, 337, 559, 560; D21/733, D21/735, 736, 752

(56) References Cited

U.S. PATENT DOCUMENTS

| | | | | | |
|---|---|---|---|---|---|
| 2,704,668 | A | * | 3/1955 | Park, Sr. | 473/300 |
| D204,890 | S | * | 5/1966 | Mader | D21/735 |
| 3,319,964 | A | * | 5/1967 | Steinberg | 473/230 |
| D209,524 | S | * | 12/1967 | Mader | D21/735 |
| 4,461,482 | A | * | 7/1984 | Bojicic | 473/254 |
| 4,511,147 | A | | 4/1985 | Olsen | |
| 4,529,202 | A | * | 7/1985 | Jacobson | 473/256 |
| 4,688,799 | A | * | 8/1987 | Johnson | 473/230 |
| 4,834,387 | A | * | 5/1989 | Waites et al. | 473/252 |
| 5,569,098 | A | * | 10/1996 | Klein | 473/300 |
| 5,582,407 | A | | 12/1996 | Sorenson | |
| 5,609,531 | A | * | 3/1997 | Gates | 473/256 |
| D378,934 | S | * | 4/1997 | Clanton | D21/743 |
| D380,513 | S | * | 7/1997 | Noda | D21/736 |
| D387,828 | S | * | 12/1997 | Reina | D21/746 |
| 5,989,131 | A | | 11/1999 | Burkholder | |
| 6,179,727 | B1 | * | 1/2001 | Giordano | 473/330 |
| 6,383,086 | B1 | | 5/2002 | Flood | |

FOREIGN PATENT DOCUMENTS

| | | | | |
|---|---|---|---|---|
| GB | WO 02/085471 A1 | * | 10/2002 | A63B 69/36 |

* cited by examiner

*Primary Examiner*—Sebastiano Passaniti
*Assistant Examiner*—Alvin A. Hunter, Jr.
(74) *Attorney, Agent, or Firm*—Harpman & Harpman

(57) ABSTRACT

A golf training device for improving a golfer's swing having a weighted contoured head that provides for proper feel of a mechanically correct golf swing. The device emulates a golf club having an elongated hollow shaft with an upper end grip end portion and a weighted contoured head at its oppositely disposed bottom end. The weighted contoured head has a flat bottom with an enlarged contoured upstanding toe end portion in longitudinally spaced relation to the shaft engagement portion. The toe end portion defines a center of gravity outwardly and beyond the lower profile of the main body member allowing the golfer to swing through in a natural beneficial manner.

5 Claims, 4 Drawing Sheets

GOLF SWING TRAINING DEVICE

BACKGROUND OF THE INVENTION

1. Technical Field

This invention relates to golf swing training aids that improve the golfer's swing by providing the correct golf swing by repetitive practice.

2. Description of Prior Art

Prior art devices of this type have relied on a variety of different designs all attempting to improve a golfer's swing by their use. Such devices typically have a club shaft with either a standard golf grip or contoured training grip on one end and a simulated golf club head or the like on the other end. This allows the golfer to repeat the proper swing mechanics so that the correct motion is achieved by repetition. Some prior art devices have a weighted club head with an offset shaft configuration, see for example U.S. Pat. Nos. 4,511,147 and 6,383,086 B1.

Other examples can be seen in U.S. Pat. No. 5,989,131 in which a golf weight training device is disclosed having a solid club shaft, the end of which is curved outwardly from the longitudinal axis of the shaft. The patent claims an enhanced swing training action due to the overall weight and axial mass displacement.

In U.S. Pat. No. 5,582,407 a swing training device is claimed having a straight weighted solid shaft with an oversize club head simulation on one end.

Other devices are available commercially as seen in the attached Exhibit A including the "Swing Perfector" which utilizes the lower portion of the shaft being vertically offset and a simulated club head on its distal end.

A "Swing Builder/Slicer Breaker" device is seen having an adjustable weight end and a contoured shaft.

A "Swing Right II" ® learning tool includes a straight shaft and weighted simulated golf heads, both irons and woods.

SUMMARY OF THE INVENTION

A golf swing training device for improving a golfer's swing by repetitive practice swings using the training device. The device simulates the proper golf swing utilizing a straight elongated hollow shaft with a contoured top hand grip portion and a bottom end portion having a monolithic solid weighted head. The weighted head is angularly offset from the longitudinal axis of the shaft with an enlarged upstanding contoured toe end portion of increased mass at its distal end. This provides an axially offset mass distribution to the head and the top grip portion, positioning the mass in angular space relation to that of the gripping portion for a "pendulum" swing action.

DESCRIPTION OF THE PREFERRED EMBODIMENT

Figure 1:
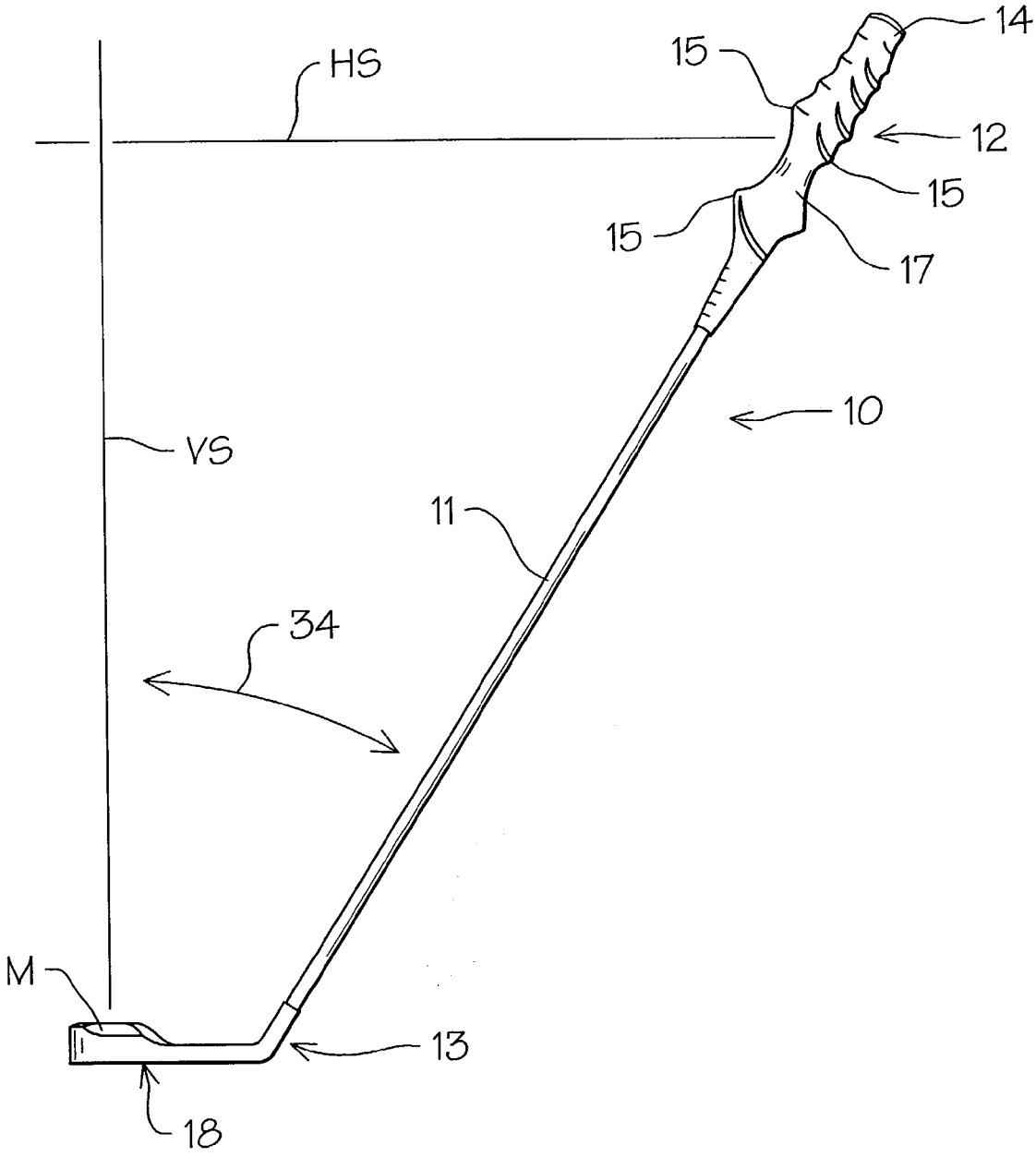
FIG. 1 is a side perspective view of the golf swing training device.

Referring to FIG. 1 of the drawings, a golf training swing device 10 of the invention can be seen having an elongated tubular shaft 11 of a metallic material with a hand grip portion 12 and a swing head portion 13 on oppositely disposed ends thereof. The grip portion 12 has a hand grip 14 with a plurality of contoured surface ridges 15 and intermediate recess areas 16 to provide a proper grip receiving surfaces 17 for a golfer's hands H to be closed there about. The preferred grip is important to the use of the swing training device 10 of the invention so that a comfortable grip can be achieved with minimal muscle tension and good inter-reaction development during the swing.

Figure 2:
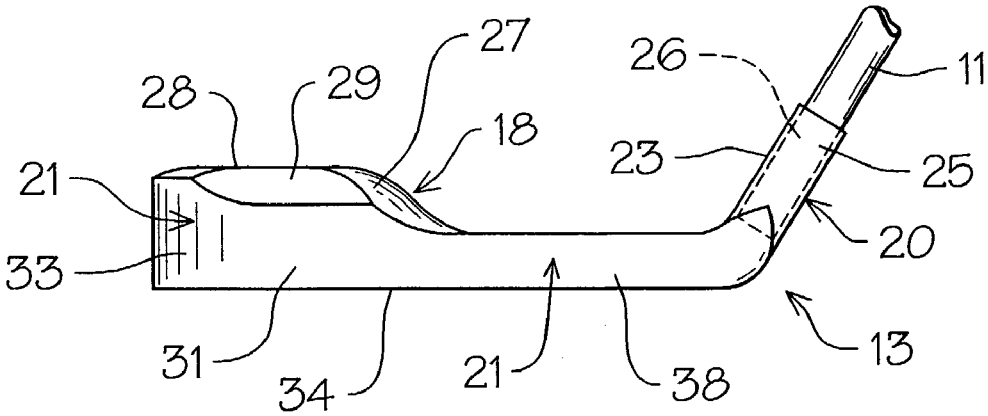
FIG. 2 is a partial enlarged side elevational view of the weighted head of the invention.

The hollow shaft 11 extends from the grip portion 12 to the swing head portion 13 on a non-divergent linear axis as will be discussed in greater detail hereinafter. The swing end portion 13 has a weighted practice head 18, best seen in FIGS. 2 and 3 of the drawings. The practice head 18 has a generally rectangular body member 19 with an upstanding shaft attachment end portion 20, a generally flat intermediate portion 21 and a contoured upstanding weighted toe end portion 22. The shaft attachment portion 20 has an angularly disposed mounting element 23 with oppositely disposed tapered sidewalls 24 and 25 terminating in a shaft receiving socket 26 there within. The intermediate portion 21 interconnects the shaft attachment portion 20 with the weighted end portion 22 so as to provide horizontal offset there between which will be discussed in greater detail hereinafter.

The weighted toe end portion 22 has an upstanding contoured configuration that extends above the horizontal plane of the intermediate portion 21, but below that of the hereinbefore described shaft attachment portion 20. The weighted end portion 22 has an arcuate inclined transition area 27 terminating at a top surface 28 there over. Oppositely disposed elongated concaved tapered areas 29 and 30 extend from respective side edges of the top surface portion 28 defining transitions to respective vertically descending side surfaces 31 and 32. An arcuate end wall surface 33 integrates with the corresponding side wall surfaces 31 and 32 to complete the weighted toe end portion 22.

It will be evident that a bottom surface 34 of the body member 19 is of a non-descript flat configuration for preferred action during use.

Figure 3:
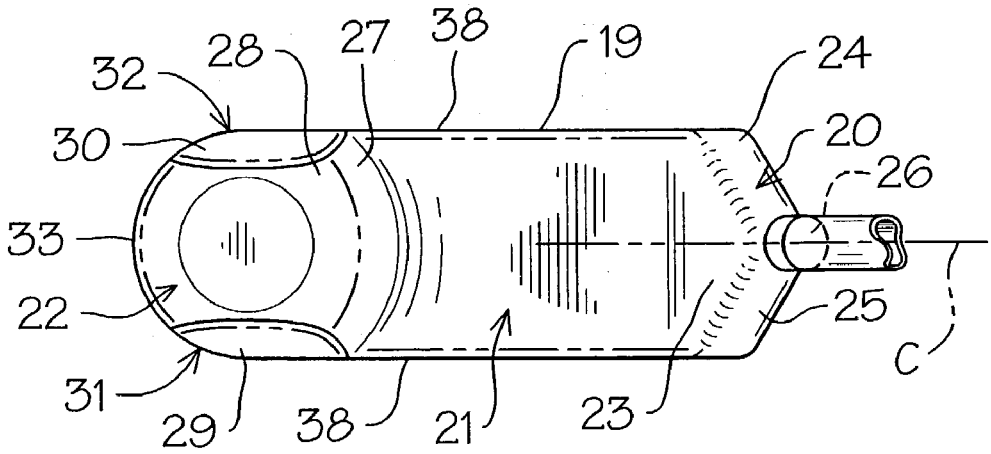
FIG. 3 is a partial enlarged top plan view of the weighted head of the invention.

Referring now to FIG. 3 of the drawings, it will be seen that the shaft receiving socket 26 within the shaft attachment portion 20 is on a center line C extending longitudinally through the length of the swing head 13 which is preferably of a monolithic cast metallic material having a weight and density greater than that of the hereinbefore shaft 11 and integrated hand grip 14.

Referring back to FIG. 1 of the drawings, the swing training device 10 unique swing training characteristics can be illustrated in which the mass M of the weighted toe end portion 22 is concentrated within the upstanding contoured toe area so as to be placed in both horizontal and vertical spaced relation to the hand grip 14 indicated by lines VS and HS respectively. This orientation is achieved by the angu larly discourse of the shaft's longitudinal axis indicated at LA from the true vertical illustrated at 34.

Figure 5:
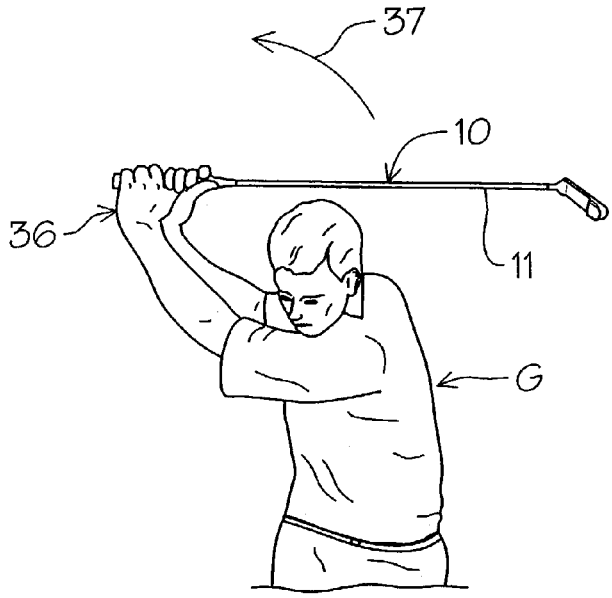
FIG. 5 is a partial perspective illustration showing the top of the practice swing.
Figure 4:
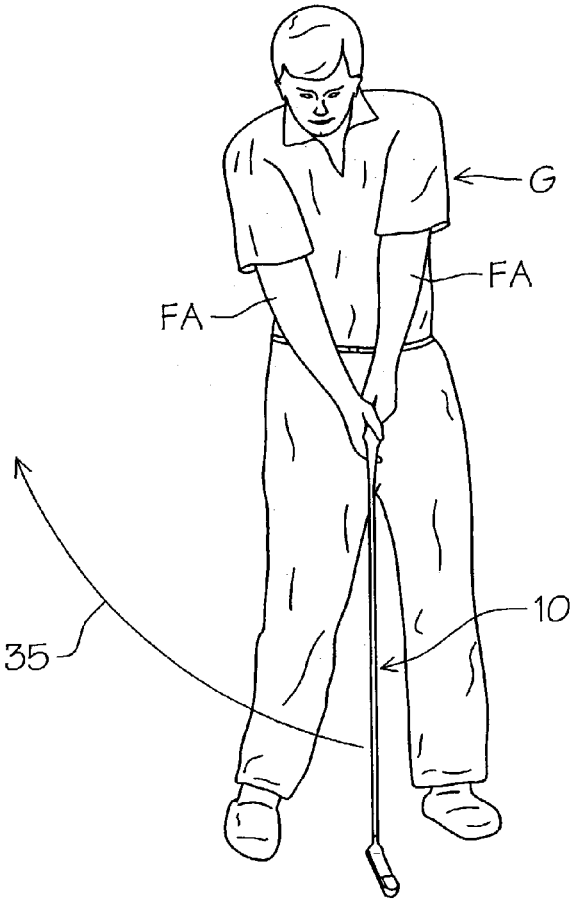
FIG. 4 is a perspective illustration indicating manner of use of the invention at the beginning of the practice swing.
Figure 6:
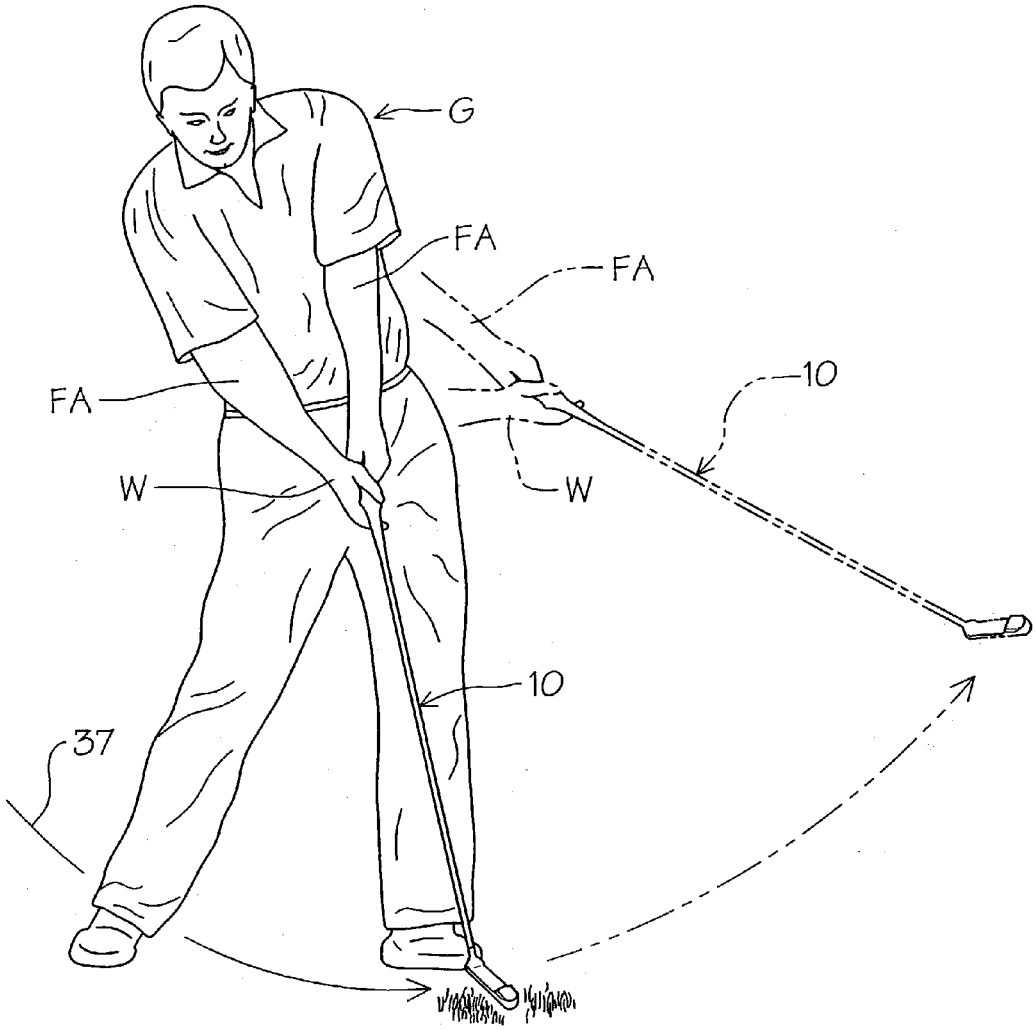
FIG. 6 is a perspective illustration in solid and broken lines showing the simulated ball engagement position approach and follow-through of the swing training device.

Referring now to FIGS. 4–6 of the drawings, the use of the swing training device 10 can be seen in which a user representation G (golfer) assumes a "address the ball position" in FIG. 4 of the drawings. As the user G swings the training swing device 10 back for a practice swing as seen in FIG. 5 of the drawings and indicated generally by the swing arrows 35, the weighted swing head 13 encourages the user to "hinge" the club at 36 correctly at the top of the swing. On the down swing as indicated by swing arrows 37 the user G forearms FA are stretched to a full extended position through simulated ball impact (shown in solid lines) in FIG. 6 of the drawings encouraging the rehinging of the user's wrist W as seen in FIG. 6 of the drawings with the follow-through illustrated in broken lines. The offset mass of the swing head portion 13 derived from positioning of the mass M in the weighted toe end portion 22 in spaced relation to the shaft engagement portion 20 forces the user G to develop a consistent swing by the properly turning of the forearms FA at impact and through the "ball" during actual golf play. Since it is important during actual play with conventional golf clubs (not shown) that the clubs strike the golf ball (not shown) squarely and not be detoured or influenced by natural occurring elements associated with play such as grass and other impediments so as not to cause a "open" or "closed" club face as will be well known and understood by those skilled in the art. To address these issues, the swing head trainer 10 is designed to "swing through" grass indicated generally at GR thus imparting a natural feel to the practice swings. This swing through action is achieved by the relationship of the respective upstanding shaft attachment portion 20 and the weighted toe end portion 22 with the relative flat intermediate portion 21 which provides the proper impact resistance due to the uniform low profile side surfaces at 38 which would be achieved as the swing training device 10 swings through the grass GR.

It will be evident from the above description that the user G can use the swing training device 10 of the invention at any time, either before, during or after play to achieve a balanced well defined golf swing for improved play.

Accordingly, after dedicated use and practice, golfers of all skill levels will find success in the game earlier during practice time at the range and on the very first hole of regular play.

Therefore we claim:

1. Golf swing training device for improving a golf swing comprising;

an elongated hollow shaft having a substantially straight longitudinal center axis, a contoured hand grip portion ending inwardly from the upper end of said shaft, a swing head portion on the lower oppositely disposed end of said shaft, said swing head portion having a monolithic solid contoured head with an upstanding shaft attachment portion on one end thereof and an upstanding weighted toe end portion in oppositely disposed relation thereto, said shaft attachment portion defining a mounting element with oppositely disposed tapered side edge portion and a shaft receiving socket therebetween, a flat intermediate portion extending between interconnecting said respective shaft attachment and weighted toe end portions said flat intermediate portion having a flat bottom surface oppositely disposed side surfaces extending at right angles thereto, said bottom surface defining a horizontal plane extending the longitudinal length of said swing head portion, said mounting element is angularly disposed in relation to said flat intermediate portion.

2. The golf swing training device set forth in claim 1 wherein said upstanding weighted toe end portion comprises, an inclined transition surface extending from said flat intermediate portion, a top surface and a flat bottom surface.

3. The upstanding weighted toe end portion set forth in claim 2 further comprises, a pair of oppositely disposed elongated contoured areas extending from said top surface thereof and in spaced relation to said bottom surface.

4. The golf swing training device set forth in claim 1 wherein said intermediate portion has a substantially flat top surface and spaced opposing flat bottom surface and a pair of oppositely disposed low profile side surfaces there between.

5. The golf swing training device set forth in claim 1 wherein said flat intermediate portion extending between and connecting said shaft attachment portion and weighted toe end portion has a flat top surface.

* * * * *